US005726355A

United States Patent [19]

Sutherland et al.

[11] Patent Number: 5,726,355

[45] Date of Patent: Mar. 10, 1998

[54] APPARATUS FOR DETECTING A CHANGE IN VOLUMETRIC INTEGRITY OF AN ENCLOSURE

[75] Inventors: Joseph Edward Sutherland; Michael John Gingell, both of Raleigh, N.C.

[73] Assignee: Alcatel Network Systems, Inc., Richardson, Tex.

[21] Appl. No.: 811,277

[22] Filed: Mar. 4, 1997

Related U.S. Application Data

[63] Continuation of Ser. No. 682,408, Jul. 17, 1996, abandoned, which is a continuation of Ser. No. 402,819, Mar. 13, 1995, abandoned.

[51] Int. Cl.[6] ..... G08B 13/22

[52] U.S. Cl. ..... 73/149; 340/566

[58] Field of Search ..... 73/149, 571, 579; 340/541, 544–546, 550, 552, 566; 109/42, 43

[56] References Cited

U.S. PATENT DOCUMENTS

| | | | |
|---|---|---|---|
| 3,990,069 | 11/1976 | Schuman | 340/544 |
| 4,225,859 | 9/1980 | Zetting et al. | 340/550 |
| 4,263,584 | 4/1981 | Spirig | 340/550 |
| 4,386,342 | 5/1983 | McKinley | 340/544 |
| 4,474,061 | 10/1984 | Parker | 73/149 |

*Primary Examiner*—Robert Raevis

*Attorney, Agent, or Firm*—Vinson & Elkins L.L.P.

[57] ABSTRACT

An apparatus for detecting a change in the volumetric integrity of the interior of an enclosure. The enclosure has an electrical interface for coupling to a circuit board and an access device for accessing said interior of said enclosure. The apparatus includes a circuit board for coupling to the electrical interface. Further, the apparatus includes evaluation circuitry connected to the circuit board for detecting the change in volumetric integrity of the enclosure, wherein the circuitry does not mechanically interact with the access device. Various other apparatus and methodology for detecting the stated change are also discussed.

3 Claims, 2 Drawing Sheets

APPARATUS FOR DETECTING A CHANGE IN VOLUMETRIC INTEGRITY OF AN ENCLOSURE

RELATED APPLICATIONS

This application is a continuation of application Ser. No. 08/682,408, filed Jul. 17, 1996, and entitled, "Apparatus for Detecting a Change in Volumetric Integrity of an Enclosure," now abandoned, which is a continuation of application Ser. No. 08/402,819, filed Mar. 13, 1995, entitled "Apparatus for Detecting a Change in Volumetric Integrity of an Enclosure," now abandoned.

This invention relates to detectors, and is more particularly directed to an apparatus and method for detecting a change in the volumetric integrity of an enclosure.

BACKGROUND OF THE INVENTION

The present invention applies where it is desirable to monitor whether an enclosure is opened or closed. For example, in the telecommunications industry, remote housings are located to shield sophisticated electronic boards and the like from outside disturbances, such as weather, vandals, or accidental contact. Typically, such housings include a door, panel, or some other type of device which may be positioned (e.g., opened or removed) to access the components within the housing. When using such structures, it is often desirable to monitor whether, either intentionally or otherwise, a housing is opened or closed.

While the above example mentions telecommunications, the need to monitor the status of a housing applies in numerous other instances, such as utility compartments, traffic controllers, and various other housings. Knowing the status of the enclosure may be a matter of safety, security, convenience, and so forth. In order to address enclosures of any type, for purposes of this document, the opened or closed status of such an enclosure is referred to as its "volumetric integrity," thereby defining that the integrity of the volume confined by a given enclosure is disturbed if the access device to the enclosure is opened. Moreover, some enclosures may have partial openings when the door or other access device is fully closed. For example, a unit may include permanent ventilation openings formed in the housing of the enclosure. Nonetheless, the housing will also include some type of access device. When the access device is closed, the volumetric integrity of the access remains substantially closed, that is, the confinement created by the housing and access device is defined notwithstanding the ventilation openings. However, when the access device is opened, the volumetric integrity changes and is detectable under the present invention as described below.

In the prior art, it is known to include electromechanical devices to determine whether the door on a housing is open. For example, a depressible microswitch may be mounted on the physical frame of the housing such that the microswitch plunger is depressed by the door in the closed position. Accordingly, when the door opens, the microswitch plunger is released so that the microswitch changes state, thereby indicating that the door position has changed.

The prior art technique suffers from various drawbacks. For example, the technique fails to serve its purpose if the housing is opened in a manner other than by opening the door which depresses the microswitch plunger. Thus, a vandal could thwart the system by removing a panel to the housing (if such panel exists) rather than disturbing the door. As another example, the hardware is mounted directly on the housing and, thus, requires configuration specific to the type of housing, as well as labor intensity from installation, wiring, and adjustment.

It is therefore an object of the present invention to provide an apparatus and method for efficiently detecting a change in the volumetric integrity of an enclosure with minimal installation, wiring, and adjustment.

It is a further object of the present invention to provide such an apparatus and method for enclosures which have a substantially constant volumetric integrity when access to the enclosure is closed, and a change in volumetric integrity when access to the enclosure is opened.

It is a further object of the present invention to provide such an apparatus and method for detecting a change in the volumetric integrity of an enclosure based on the acoustical characteristics within the enclosure.

It is a further object of the present invention to provide such an apparatus and method which may be installed on a circuit board so that it is easily inserted into, and removed from, a housing along with the circuit board.

It is a further object of the present invention to provide both analog and digital techniques for detecting a change in the volumetric integrity of an enclosure.

It is a further object of the present invention to provide a digital technique for detecting a change in the volumetric integrity of an enclosure, whereby the technique may be embodied primarily in a microprocessor chip or the like.

Still other objects and advantages of the present invention will become apparent to those of ordinary skill in the art having references to the following specification together with its drawings.

SUMMARY OF THE INVENTION

The present invention includes an apparatus for detecting a change in the volumetric integrity of the interior of an enclosure. In one embodiment, the enclosure has an electrical interface for coupling to a circuit board and an access device for accessing the interior of the enclosure. The apparatus includes a circuit board for coupling to the electrical interface. Further, the apparatus includes evaluation circuitry connected to the circuit board for detecting the change in volumetric integrity of the enclosure, wherein the circuitry does not mechanically interact with the access device.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

The preferred embodiment of the present invention and its advantages are best understood by referring to FIGS. 1–5 of the drawings, like numerals being used for like and corresponding parts of the various drawings.

Figure 1:
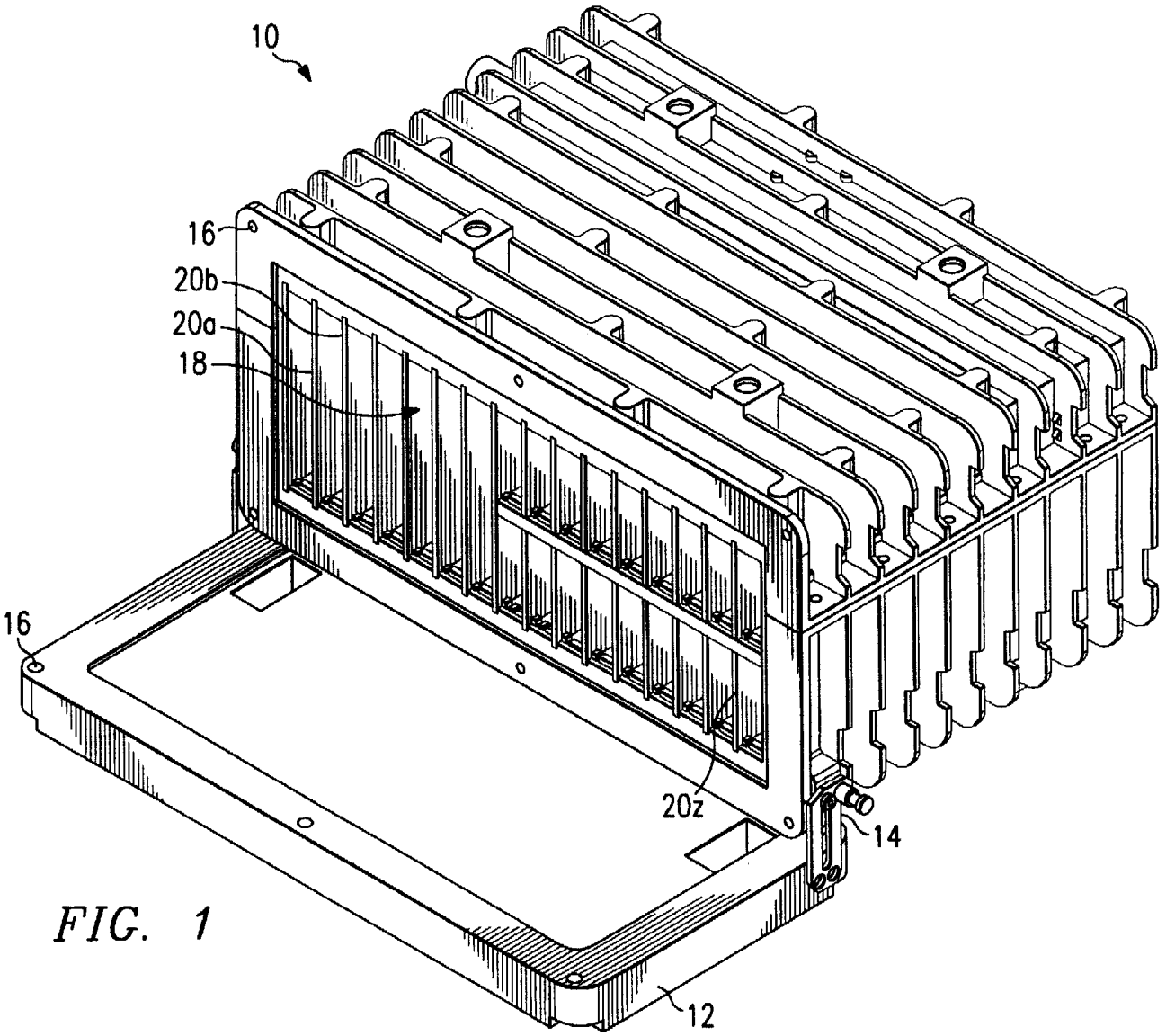
FIG. 1 illustrates an optical network unit as an exemplary housing for use with the present invention.

FIG. 1 illustrates a housing designated generally at 10. Housing 10 is typical of that used in the telecommunications field and is sometimes referred to as an optical network unit. Although the optical network unit is used as an example, it should be noted that the present invention applies equally as well to other enclosures wherein it is desirable to monitor whether the enclosure is opened or closed. In FIG. 1, a housing door 12 is pivotally mounted on a door hinge 14 located on the bottom of one end of housing 10. Housing 10 and housing door 12 have three corresponding pairs of cover coupling holes 16 spaced around the periphery of housing interior 18.

Housing 10 includes a plurality of circuit boards designated generally as 20*a* through 20*z* which are often vertically disposed within the interior 18 of housing 10. Although not shown in FIG. 1, circuit boards 20*a* through 20*z* typically plug into a mating connector in the rear of housing interior 18. Although housing interior 18 is shown in FIG. 1 to enclose a variety of circuit boards, it may also be designed to accommodate alternative components (electronic or otherwise) as well.

The use of housing 10 in the preferred embodiment is as follows. Housing door 12 is pivoted downward about hinge 14 to expose housing interior 18. Thus, interior 18 is accessible for addition or removal of circuit boards 20*a* through 20*z* (or other components). Once the desired activity within interior 18 is accomplished, housing door 12 is pivoted upward about hinge 14 so that housing door 12 encloses housing interior 18. Machine screws (not shown) are inserted through door coupling holes 16 to secure housing door 12 over housing interior 18.

From the above, it may be appreciated that housing 10 is easily opened or closed to access its interior components. In accordance with the present invention, it is desirable to detect when such activity takes place. The optical network unit is typically a remotely located device, and connected via a communications link (e.g., fiber optic, radio transmission, or the like) to a communications station. Thus, in the preferred embodiment, a detector is included within interior 18 of housing 10 and the status of the door (opened or closed) is monitored. Detection of the door status may be communicated via the communications link to the communications station. Consequently, if the door is unintentionally opened, the communications station is alerted and may take appropriate action.

As stated above, the present invention detects a change in the volumetric integrity of an enclosure. Given housing 10 of FIG. 1, the invention detects a change in the volumetric integrity of interior 18. In the preferred embodiments detailed below, the apparatus for performing the detection functionality is affixed to one of circuit boards 20*a* through 20*z*, and does not mechanically interact with door 12. Consequently, the detection apparatus is easily installed by simply inserting the subject circuit board into place, and does not require manual adjustment with respect to door 12. In addition, because the detection apparatus is attached to a circuit board, no additional wiring is required as is the case in the prior art. Still further, the detection apparatus is easily inserted into, and removed from, a housing along with the circuit board.

Figure 2:
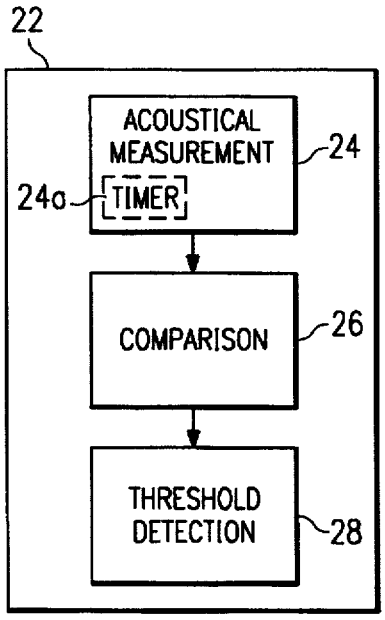
FIG. 2 illustrates a block diagram of the present invention.

FIG. 2 illustrates a block diagram of the detection apparatus of the present invention designated generally at 22. Apparatus 22 implements acoustical principles to detect a change in volumetric integrity of an enclosure. In other words, under the present invention, if the acoustics within the interior of the subject enclosure have changed beyond a tolerance, it is assumed that the volumetric integrity of the enclosure has changed. Thus, the block components of apparatus 22 are located within the interior of an enclosure, such as interior 18 in FIG. 1, at a location where acoustical responses may be measured.

In the block diagram of FIG. 2, apparatus 22 includes an acoustical measurement circuit 24 which measures acoustical characteristics of the enclosure which houses apparatus 22. Various embodiments are described below for making such measurements, and it is readily appreciated that the acoustical characteristics of the enclosure are defined by the way sound travels (and reflects) within the interior of the enclosure. Apparatus 22 further includes a comparison circuit 26 coupled to measurement circuit 24, and a threshold detection circuit 28 coupled to comparison circuit 26. The functions of this additional apparatus are appreciated from the operational description below.

A timer 24*a* is also shown in dashed lines within acoustical measurement circuit 24 to illustrate control of the timing in which circuit 24 makes its measurements. As appreciated from the operational description below, dashed lines are used because timer 24*a* indicates a function, that is, that circuit 24 makes its measurements at different points in time; however, these points in time may be discretely fixed or on a continuous basis. Moreover, dashed lines further indicate that timer 24*a* is included to indicate a function but, as appreciated from the embodiments of FIGS. 3–5, may not necessarily require the presence of independent circuitry (i.e., the measurement circuitry 24 may inherently take measurements at different times).

The operation of apparatus 22 is as follows. Over a first period, acoustical measurement circuit 24 measures a first acoustical characteristic of the interior of the subject enclosure. As suggested above, timer 24*a* is included to indicate this timing feature. Next, over a second period (again indicated by timer 24*a*), acoustical measurement circuit 24 measures a second acoustical characteristic of the interior of the subject enclosure. Comparison circuit 26 then compares the first and second acoustical characteristics. Last, threshold detection circuit 28 examines the result of the comparison, and if it is beyond a given tolerance, it is therefore determined that the acoustics within the interior of the subject enclosure have changed. From this conclusion, it is assumed that the volumetric integrity of the enclosure has changed, such as by opening of the door or other access to the interior of the enclosure. If the subject enclosure is the optical network unit of FIG. 1, the indication may then be communicated to the communications station so that the appropriate action may be taken.

Figure 3:
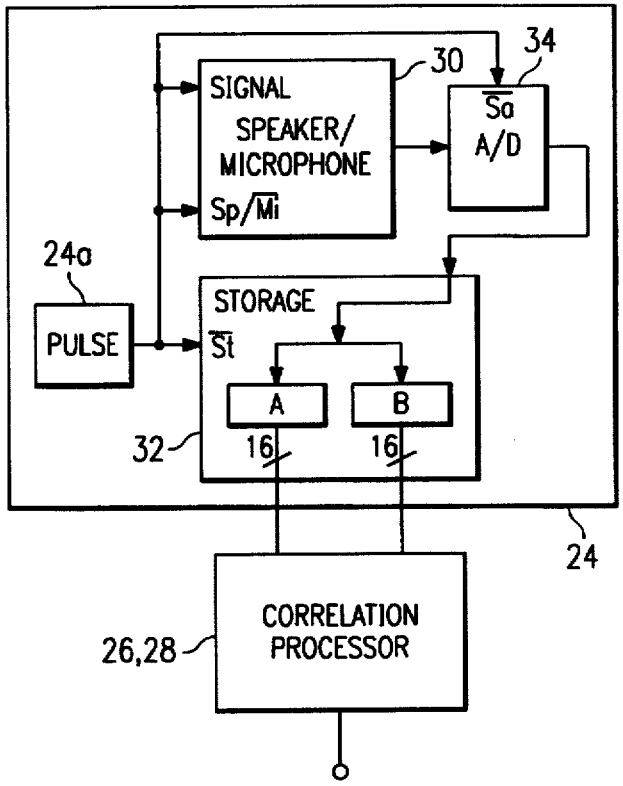
FIG. 3 illustrates the preferred embodiment of the present invention using primarily digital components to detect a change in the volumetric integrity of an enclosure.

FIG. 3 illustrates a diagram of the preferred embodiment of the block diagram of FIG. 2. Acoustical measurement circuit 24 includes a pulse circuit labeled 24*a* to correspond to timer 24*a* of FIG. 2. Pulse circuit 24*a* is coupled to provide a pulse to the mode and data inputs of a speaker/microphone 30, and to the enable inputs of a storage device 32 and an analog-to-digital (A/D) sampler 34. In the preferred embodiment, speaker/microphone 30 is a ceramic audio transducer and, thus, as known in the art, is operable to produce a sound in response to an electrical input, or produce an electrical output in response to sound vibrations imposed on the transducer. The signal output of speaker/microphone 30 is coupled to the data input of A/D sampler 34. The signal output of A/D sampler 34 is coupled to the data input of storage device 32. Storage device 32 includes two storage elements A and B for storing digital samples (or representations derived from such samples) produced by A/D sampler 34. For purposes of example, consider each digital sample to be a sixteen bit quantity.

In FIG. 3, the functionality of comparison circuit 26 and threshold detection circuit 28 are combined and performed by a correlation processor 26, 28 coupled to receive the sixteen bit digital sample quantities stored in storage elements A and B of storage circuit 32. Correlation processors are known in the art and are operable to determine the extent of correlation between two digital signals. Thus, correlation processor 26, 28 is operable to evaluate the correlation between the respective samples in each of storage elements A and B. As also known in the art, correlation processor 26, 28 includes a programmable threshold so that a threshold may be input to the processor, and it will respond according to whether or not the correlation it determines exceeds the programmed threshold. Note as an alternative that correlation processor 26, 28 functionality could be accomplished using any of many types of commercially available digital signal processors ("DSP"). Such DSPs are easily programmed using known methods to correlate two different digital values, and act in response to the calculated correlation.

The operation of the apparatus of FIG. 3 is as follows. With the volumetric integrity of the housing in a known state by closing the housing door, pulse circuit **24*a* issues a high pulse signal at its output. The high pulse signal places speaker/microphone 30 in a speaker mode. In addition, because the pulse is connected to the signal input, speaker/microphone 30 issues a click sound within the interior of the enclosure which houses acoustical measurement circuit 24. Note also that delay circuitry (not shown) might be included so that the pulse input to the signal input of speaker/microphone 30 is delayed slightly; consequently, speaker/microphone 30** fully switches to the speaker mode before being pulsed and issuing the click. As appreciated below, this click is an excitation mechanism which causes reflections (i.e., an echo train) within the housing which are thereafter sampled to create an acoustic "fingerprint" of the housing interior when the housing door is closed, that is, a known pattern which acoustically identifies the unique interior shape of the enclosure and its contents.

Next, the pulse from pulse circuit **24*a* goes low, and thereby changes the mode of speaker/microphone 30 from speaker to microphone. In addition, the low pulse enables the operation of both A/D sampler 34 and storage device 32. Thus, the microphone receives the sound reflections or echo train caused by the click, and produces an analog signal in response to those sounds. The analog signal is coupled to A/D sampler 34 and, thus, is sampled over a period of time. Further, A/D sampler 34 outputs a digital sequence of bits as a digital representation of the sampling over the period of time. Because storage device 32** is enabled, it stores the digital representation in its storage element A. Thus, from the above, note that the operation thus far has measured a first acoustical characteristic of the enclosure over a first time period.

At a later time, the operation repeats the steps immediately above to measure a second acoustical characteristic of the enclosure over a second time period, where the second time period is the same in duration as the first time period. In this instance, however, the digital representation of the sampling over the second period of time is stored in storage element B of storage device 32. Thus, at this point, storage circuit 32 has stored both a first and second acoustical characteristic of the enclosure.

Recall in connection with FIG. 2, comparison circuit 26 compares the first and second acoustical characteristics. In the embodiment of FIG. 3, correlation processor 24, 26 accomplishes the comparison using known operational steps on the two sixteen bit quantities stored in elements A and B, respectively, to determine a correlation between those two quantities. Further, the threshold functionality of correlation processor 24, 26 compares the result of the correlation with the pre-programmed correlation threshold. If the resultant correlation is below the pre-programmed correlation threshold, correlation processor 24, 26 outputs a signal in a first state, whereas if the resultant correlation is above the pre-programmed correlation threshold, correlation processor 24, 26 outputs a signal in a second state. Thus, the preferred embodiment includes some level of tolerance in comparing the two measured acoustical characteristics. Note that the tolerance may be adjusted to accommodate a particular structure based on empirical testing and the like.

Note that the tolerance feature prevents the apparatus of FIG. 3 from responding to insubstantial changes in the acoustical interior. For example, as stated above, the present invention also operates in housings which include some type of ventilation or other negligible opening to the housing. Under typical conditions, these other openings may allow some minimal amount of noise disturbance within the interior of the enclosure. However, the tolerance feature is easily used and adjusted to disregard such disturbances which are not attributed to a change in the volumetric integrity of an enclosure.

In the embodiment described above, the sixteen bit digital sample quantities stored in storage elements A and B of storage circuit 32 are measured based on a single respective click and measurement of speaker/microphone 30; however, note in the preferred embodiment that each digital sample is the result of an averaging technique taken after multiple excitations/measurements. Thus, the steps for generating each digital sample quantity set forth above are repeated numerous times, and some circuit such as a microprocessor or DSP is used to average each resultant measurement. The average is then stored in either element A or B, as shown by example immediately below.

As an example of the averaging technique, to generate the quantity for storage element A, with the volumetric integrity of the housing in a known state by closing the housing door, pulse circuit **24*a* issues a high to pulse speaker/microphone 30 in its speaker mode, thereby causing the click described above. Immediately thereafter, the mode of speaker/microphone 30 is changed to perform a microphone function while A/D sampler 34** is enabled. The resulting measurement may be stored in element A, or in some temporary storage area. In either instance, the process is immediately repeated a preferred number of times (e.g., 10), each time averaging along with previous digital samples caused and measured with the volumetric integrity of the housing in a known state. Ultimately, the final average is stored in element A which, therefore, then stores a first acoustical characteristic of the enclosure over a first time period. One skilled in the art also will appreciate that the same multiple excitation/measurement process is implemented at a later time to generate the second acoustical characteristic of the enclosure over a second time period, where the second acoustical characteristic is stored in element B, again representing an averaging determined during the second time period. Note that the preferred averaging method reduces the effect of noise on the data samples. After obtaining these averaged samples, the two respective values in elements A and B are then analyzed in any of the manners set forth above.

Also in the above embodiment, speaker/microphone 30 is disposed within the enclosure in a general fashion and thus responds to an overall change in volumetric integrity. As an alternative, in order to increase sensitivity with particularity to the door of the enclosure, speaker/microphone 30 may be situated to emit its sound directly toward the door of the enclosure. Consequently, the embodiment operates in a SONAR type fashion, that is, by emitting sound to, and receiving reflection from, the door structure. Thus, even a slight displacement of the door (e.g., slightly ajar) is readily detectable by the embodiment.

From the above, therefore, one skilled in the art will recognize that the present invention provides the ability to determine whether the acoustics of an enclosure are unchanged or substantially unchanged given a tolerance. From this determination, it is assumed that the volumetric integrity of the enclosure also has not changed and that the door or other access to the enclosure interior remains closed. Note also that the preferred embodiment of FIG. 3 is by way of example, and may be changed or altered by a person skilled in the art. For example, a sound other than a click may be emitted by speaker/microphone 30 to measure the acoustical characteristics within the enclosure. As another example, other types of sound recognition and sound comparison techniques may be employed. As a further example, a separate or different type of excitation mechanism may be used. As yet another example, while separate components are shown in FIG. 3, note that each component shown other than speaker/microphone 30 may be incorporated into a single ASIC, or may be performed by a low cost microprocessor. Indeed, such a device is easily affixed to one of circuit boards 20*a* through 20*z* according to methods known in the art. Still further, in many instances a microprocessor is already present on a given circuit board for performing other functions associated with that circuit board. In such an instance, the existing microprocessor may be further programmed to perform the above-described functionality. In addition to the above examples, the following describes alternative embodiments consistent with the teachings of the present invention.

Figure 4:
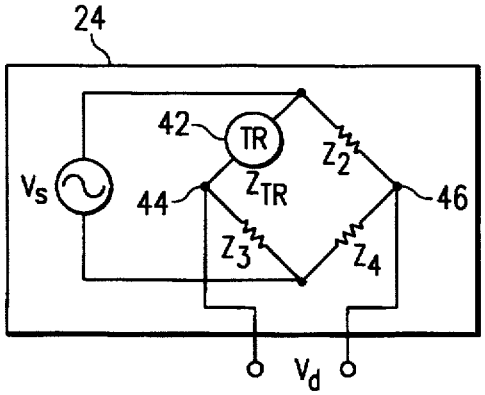
FIG. 4 illustrates an alternative embodiment of the present invention using a circuit bridge configuration including an acoustically variable impedance to detect a change in the volumetric integrity of an enclosure.

FIG. 4 illustrates an alternative embodiment for acoustical measurement circuit 24 of FIG. 2, wherein the embodiment preferably uses analog components to perform the functions set forth in the present invention. In FIG. 4, acoustical measurement circuit 24 includes an impedance bridge configuration including an acoustical impedance device 42, and three complex impedance devices $Z_2$, $Z_3$, and $Z_4$. In the preferred embodiment, acoustical impedance device 42 is an audio transducer; however, it should be understood that the term "acoustical impedance device" is used to include other components which provide an impedance which varies in response to the sound imparted on the device. Although not shown, acoustical impedance device 42 is also biased with whatever potential is necessary given the particular device chosen. The bridge is also supplied with a source voltage, $v_s$, and defines a voltage $v_d$ across its nodes 44 and 46.

As is known in the art, an audio transducer produces an impedance in accordance with the sounds imparted on it. In FIG. 4, this impedance is denominated $Z_{TR}$. Once acoustical impedance device 42 is selected, the remaining impedances $Z_2$, $Z_3$, and $Z_4$ are preferably selected so that the bridge remains substantially balanced when the enclosure which houses the bridge is closed. Particularly, as known in the bridge circuit art, such a balanced condition is met so long as the following Equation 1 is met:

$$\frac{Z_{TR}}{Z_2} = \frac{Z_3}{Z_4} \qquad \text{Eqn. 1}$$

Thus, $Z_{TR}$ is measured when the volumetric integrity of the enclosure is such that the door is closed. Next, impedances $Z_2$, $Z_3$, and $Z_4$ are chosen to satisfy Equation 1, and are connected in the bridge configuration of FIG. 4. Consequently, when the volumetric integrity of the enclosure is such that the door is closed, the bridge is balanced and, therefore, by definition, the potential $v_d$ is zero. To the contrary, when the volumetric integrity of the enclosure is disturbed, such as when the door is opened, $Z_{TR}$ changes and imbalances the bridge. As known in the art, when the bridge becomes imbalanced, a voltage drop occurs nodes 44 and 46 and, thus, is reflected in the potential $v_d$.

From the above, note that acoustic measurement circuit 24 of FIG. 4 complies with the corresponding function of the configuration of FIG. 2. Note, however, that no timer 24*a* is shown in FIG. 4, as the embodiment of FIG. 4 provides a continuous signal, $v_d$, representative of the acoustic environment which houses the bridge circuit. As stated in connection with FIG. 2, the present invention samples the acoustic environment over successive periods, and determines if the acoustic environment has changed based on the difference, if any, between those samples. Because the embodiment of FIG. 4 provides a continuous signal $v_d$, this signal may be sampled continuously and, thus, the "sample period" would be the short instant each time $v_d$ is measured. As an alternative, $v_d$ may be sampled at spaced apart time intervals (e.g., every second, minute, hour, etc.), to detect a change in acoustic environment and, hence, a change in volumetric integrity.

Note also that if the circuit is initially balanced, then the first measurement of $v_d$ over the first period or instance will be zero volts. Thus, for subsequent measurement samples, if $v_d$ exceeds zero volts, again it may be assumed that the acoustical characteristics within the enclosure have changed, and that such change is attributable to a change in the enclosure's volumetric integrity. An alternative technique, however, uses a comparison voltage other than zero volts. In particular, rather than choosing impedances $Z_2$, $Z_3$, and $Z_4$ to balance the bridge, an alternative is, regardless of whether the bridge is balanced, to measure $v_d$ when it is known that the enclosure is closed and thereby obtain a base voltage level, $v_{dref}$. Thereafter, $v_d$ is sampled to determine if it has changed from the base voltage level. If such a change occurs, again it is assumed that the enclosure's volumetric integrity has changed as indicated by the change in its acoustical characteristics.

Given the embodiment of FIG. 4, if continuous sampling is used, then $v_d$ is connected directly to a threshold detector. The threshold level required by the threshold detector would provide a tolerance in a manner similar to the embodiment of FIG. 3. In other words, if the threshold detector included a predetermined tolerance, then its output would change only if the absolute value of $(v_d - v_{dref})$ exceeded the tolerance. Thus, slight changes which occurred in $v_d$ would be insufficient to trigger a change in the threshold detector output and, thus, would not indicate a change in volumetric integrity. As an alternative, the embodiment of FIG. 4 could be connected to a discrete system which analyzes $v_d$ from time to time. For example, an A/D converter could be used to store digital representations of $v_d$ which are compared with one another to detect a change in the digital representations and, thus, indicate a change in the volumetric integrity of the enclosure.

The embodiment of FIG. 4 also illustrates that the present invention does not necessarily include an excitation mechanism such as the speaker function of FIG. 3. Particularly, the acoustic measurements may be taken simply by measuring the typical noise, or a lack thereof, within the enclosure when it is closed versus opened. Indeed, the clicking function could be eliminated from the FIG. 3 embodiment as well while relying solely on the already existing noise within the enclosure. As added flexibility, however, the embodiment of FIG. 4 could be modified to specifically include an excitation mechanism such as the speaker function of FIG. 3, with $v_d$ sampled at a known time after the speaker was activated.

Figure 5:
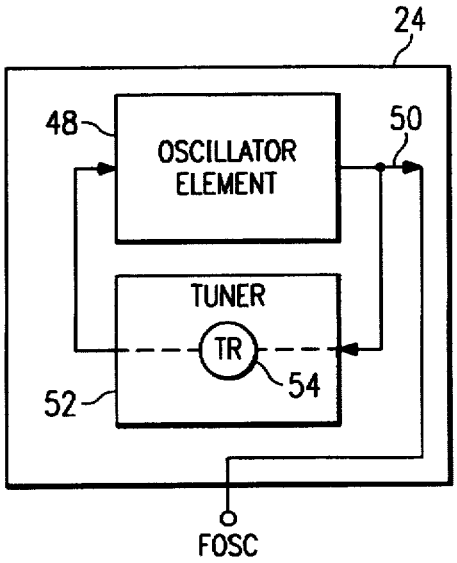
FIG. 5 illustrates an alternative embodiment of the present invention using an oscillator circuit including an acoustically variable impedance to detect a change in the volumetric integrity of an enclosure.

FIG. 5 illustrates another alternative embodiment for acoustical measurement circuit 24 of FIG. 2. In FIG. 5, acoustical measurement circuit 24 includes an oscillator element 48 having an output 50 producing an oscillation frequency, $f_{osc}$. As is common in the oscillator art, output 50 is connected to provide positive feedback through a tuner circuit 52 and back to oscillator element 48. In accordance with the present invention, however, tuner circuit 52 includes an acoustical impedance device 54 which, like the embodiment of FIG. 4, is a ceramic audio transducer. Further, because of the location of acoustical impedance device 54 within the enclosure, a change in the impedance of acoustical impedance device 54 changes the overall tuning impedance and, therefore, changes either or both the amplitude or frequency of $f_{osc}$.

Given the above, one skilled in the art will readily recognize that the embodiment of FIG. 5, like the embodiment of FIG. 4, provides a continuous output signal (i.e., $f_{osc}$) which will vary in response to an acoustical change in the enclosure which houses the circuit of FIG. 5. Note also that either the amplitude or frequency of $f_{osc}$ may change depending on the design of the circuit. Particularly, the circuit may be tuned to have a high Q at the expected frequency under normal conditions (i.e., enclosure closed). In such an event, once the enclosure opens, the amplitude of $f_{osc}$ will decrease, thereby indicating a change in volumetric integrity. As an alternative, the circuit may be tuned to have a relatively flow Q point around the expected frequency under normal conditions and, thus, once the enclosure opens, the frequency of $f_{osc}$ will decrease, again indicating a change in volumetric integrity. In addition, many of the statements applying to FIG. 4 apply equally to FIG. 5 and need not be restated in detail. Again, a base reference may be obtained by taking a first sample of $f_{osc}$ when it is known that the volumetric integrity of the enclosure is closed. Thereafter, the base signal may be normalized and subsequent samples compared directly to either the base or normalized value to detect a change. Moreover, the subsequent analyses may be continuous, or discretely spaced apart, and may include some level of tolerance to disregard insubstantial changes (i.e., either amplitude or frequency) in $f_{osc}$.

As is known, sound is simply a variation in air pressure. Thus, the embodiments above each respond to a change in air pressure, where that change is evaluated in the form of dynamic variations. As an alternative embodiment, however, note that an enclosure, such as the optical network unit 10 of FIG. 1, is often pressurized. Consequently, in this instance, a static response, rather than a dynamic response, measurement may be made of pressure in order to detect a change in the volumetric integrity of the pressurized enclosure. In this embodiment, a pressure transducer with a built-in reference is preferred rather than an audio detecting transducer. For example, economical solid-state pressure transducers with built-in sea level reference chambers are readily available. Thus, in such an embodiment, the transducer periodically measures the pressure within the enclosure, and outputs a differential signal based on a comparison of the measurement with its sea level reference. While the enclosure remains pressurized, the transducer output remains constant. However, if the volumetric integrity of the pressurized enclosure is disturbed, then the differential signal changes, thereby indicating a change in the volumetric integrity of the pressurized enclosure.

From the above, it may be appreciated that the embodiments of the present invention provide an apparatus and method for detecting a change in the volumetric integrity of an enclosure. While the preferred embodiment has been described in detail, various substitutions, modifications, or alterations also have been described and illustrate the scope of the present invention. Still other examples of changes could be made by a person skilled in the art. For example, while the components of FIG. 2 are all preferably located on a single circuit board, only circuit 24 need be within the enclosure interior and, thus, the remaining components could be remotely located from the enclosure. Still other examples by a person skilled in the art could be made to the description set forth above without departing from the invention which is defined by the following claims.

What is claimed is:

1. An apparatus for detecting a change in the volumetric integrity of an enclosure having an interior, the apparatus comprising:

means for sequentially generating a first signal and a second signal;

a speaker device for outputting a reference sound in response to the first signal;

a microphone device for receiving an acoustical characteristic in response to the second signal, the acoustical characteristic resulting from the reference sound interacting with the interior of the enclosure;

circuitry for measuring the acoustical characteristic;

circuitry for averaging a plurality of measurements of the acoustical characteristic; and detection circuitry for providing an indication of a change in the volumetric integrity of the enclosure if a subsequently measured acoustical characteristic is beyond a tolerance in comparison with an average of previously measured acoustical characteristics.

2. The apparatus as defined in claim 1 wherein the acoustical characteristic is an acoustical analog characteristic, and the circuitry for measuring the acoustical characteristic further includes circuitry for converting the acoustical analog characteristic into a digital characteristic.

3. The apparatus as defined in claim 1, wherein the speaker device and the microphone device are contained within a single speaker/microphone device.

* * * * *